US012571604B2

(12) United States Patent
Granier et al.

(10) Patent No.: US 12,571,604 B2
(45) Date of Patent: Mar. 10, 2026

(54) FIREARM FOR UNMANNED UNDERWATER VEHICLES

(71) Applicant: Energetic Materials & Products, Inc., Round Rock, TX (US)

(72) Inventors: John Joseph Granier, Round Rock, TX (US); Dennis Eugene Wilson, Cedar Park, TX (US)

(73) Assignee: Energetic Materials & Products, Inc., Round Rock, TX (US)

( * ) Notice: Subject to any disclaimer, the term of this patent is extended or adjusted under 35 U.S.C. 154(b) by 384 days.

(21) Appl. No.: 18/240,163

(22) Filed: Aug. 30, 2023

(65) Prior Publication Data

US 2024/0328740 A1 Oct. 3, 2024

Related U.S. Application Data

(60) Provisional application No. 63/455,979, filed on Mar. 31, 2023.

(51) Int. Cl.
*F41A 23/02* (2006.01)

(52) U.S. Cl.
CPC ..... *F41A 23/02* (2013.01)

(58) Field of Classification Search
CPC ..... F41A 23/02
See application file for complete search history.

(56) References Cited

U.S. PATENT DOCUMENTS

| | | | | |
|---|---|---|---|---|
| 2,804,804 | A * | 9/1957 | Cumming | F41A 1/04 89/27.13 |
| 4,505,018 | A * | 3/1985 | Regalbuto | F41C 9/06 411/441 |
| 7,984,581 | B2 * | 7/2011 | Rapp | F41A 1/10 89/1.7 |
| 8,915,004 | B1 * | 12/2014 | Langner | F42B 12/02 42/69.01 |
| 11,466,946 | B1 * | 10/2022 | Smith | F41A 7/08 |
| 11,603,177 | B1 * | 3/2023 | Granier | F41A 35/04 |
| 2019/0101344 | A1 * | 4/2019 | Polovnev | F41A 1/08 |

* cited by examiner

*Primary Examiner* — S. Joseph Morano
*Assistant Examiner* — Jovon E Hayes
(74) *Attorney, Agent, or Firm* — Antony P. Ng; Russell Ng PLLC

(57) ABSTRACT

An underwater firearm is disclosed. The underwater firearm includes a barrel for receiving an ammunition. A slip mechanism is utilized to removably secure the underwater firearm to an unmanned underwater vehicle. The slip mechanism includes a pillow block secured to the unmanned underwater vehicle, a shear ring situated within a barrel groove of the barrel, a collet wrapped around the shear ring, and a capture nut, along with the collet, for confining the shear ring within the barrel groove in order to secure the barrel in order to enable accurate aiming before firing.

18 Claims, 6 Drawing Sheets

FIREARM FOR UNMANNED UNDERWATER VEHICLES

RELATED PATENT APPLICATION

The present patent application is related to provisional application No. 63/455,979 filed on Mar. 31, 2023, the contents of which are incorporated herein by reference.

TECHNICAL FIELD

The present invention relates to firearms in general, and in particular to a small to medium caliber firearm for unmanned underwater vehicles.

BACKGROUND

Firearms for unmanned ground vehicles are well-known. Mounted on a robotic vehicle, a firearm can be aimed using a live video feed, and can be fired via remote control by a human operator. In addition, the vehicle is designed and fabricated to handle the recoil forces of the firearm.

Unmanned underwater vehicles are commonly used for video and sonar surveillance. Designing a firearm to function underwater and not overburden or damage an unmanned underwater vehicle is much more difficult compared to unmanned ground vehicles. A recoilless firearm having a heavy projectile would require an increase of the propellant charge weight and an increase in the length and weight of the barrel for accelerating the projectile. Furthermore, the propellant gas exhausting from the barrel into the opposite side of the shot can create a hydraulic shock, the impact of which on the gun carriage and on the firearm carrier is much greater than the recoil from a shot of a traditional firearm.

The present disclosure provides a firearm to be used in unmanned underwater vehicles.

SUMMARY OF THE INVENTION

In accordance with one embodiment, an underwater firearm includes a barrel for receiving an ammunition on a first end and a barrel cap for covering a second end of the barrel. The underwater firearm also includes a capsule having a firing pin and contains a reactive material. The reactive material can be ignited by an electrical ignitor in order to propel the firing pin to strike the ammunition. A housing is utilized to contain the capsule and the electrical ignitor. In addition, a slip mechanism is utilized to removably secure the underwater firearm to an unmanned underwater vehicle. The slip mechanism includes a pillow block secured to the unmanned underwater vehicle, a shear ring situated within a barrel groove of the barrel, a collet wrapped around the shear ring, and a capture nut, along with the collet, for confining the shear ring within the barrel groove in order to secure the barrel in order to enable accurate aiming before firing.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
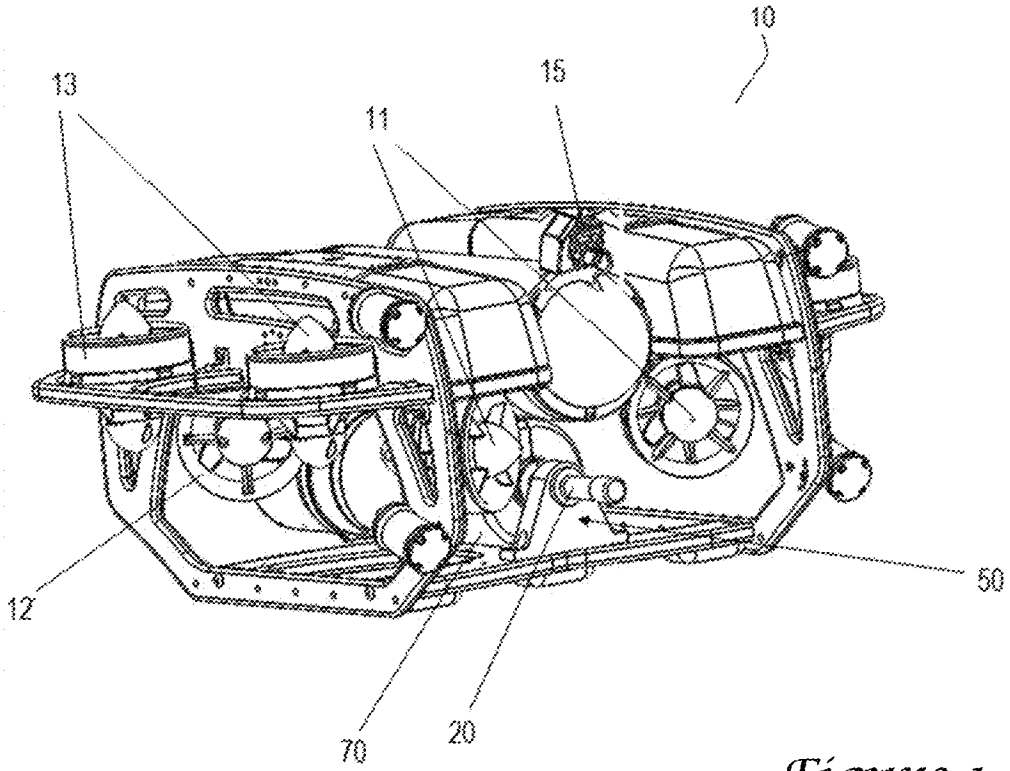
FIG. 1 is an isometric view of an unmanned underwater vehicle on which an underwater firearm is installed.

Referring now to the drawings and in particular to FIG. 1, there is illustrated an isometric view of an unmanned underwater vehicle on which an underwater firearm is installed. As shown, an unmanned underwater vehicle 10 includes a body equipped with horizontal propulsion systems 11-12 and vertical propulsion systems 13. Unmanned underwater vehicle 10 includes a camera 15 for providing images of the underwater conditions.

Unmanned underwater vehicle 10 can be controlled by a control unit (not shown). The control unit may include a rugged chassis sufficient to house and protect electronic circuits used for controlling unmanned underwater vehicle 10. The control unit may also include joysticks adapted to provide input from a user for maneuvering unmanned underwater vehicle 10 while unmanned underwater vehicle 10 is submerged under water. In addition, the control unit includes a display adapted to display images obtained by camera 15 of unmanned underwater vehicle 10. A flexible cable can be utilized to connect the control unit to unmanned underwater vehicle 10 to allow unmanned underwater vehicle 10 to transmit and receive signals between the control unit to unmanned underwater vehicle 10.

An underwater firearm 20 is mounted on unmanned underwater vehicle 10 via various mechanical linkages. Preferably, firearm 20 is mounted in view of camera 15 to allow a driver to aim underwater firearm 20 by tilt, pitch and rotation of unmanned underwater vehicle 10. Unmanned underwater vehicle 10 can be stationary having actuators to tile, pitch, and rotate firearm 20 relative to unmanned underwater vehicle 10. As shown, firearm 20 is wrapped within a floatation cover 70. The purpose of floatation cover 70 is to provide proper buoyancy for firearm 20 when unmanned underwater vehicle 10 is being submerged under water. Floatation cover 70 is made of rigid closed cell polymer foam material. The foam should be capable of surviving underwater pressure conditions. The foam can be designed with a rigid polymer (glass reinforced nylon) shell to survive the gun recoil.

In addition, firearm 20 is removably attached to a slip mechanism 50 having a rigid joint that is purposely designed to release or break at a low force. Slip mechanism 50 keeps underwater firearm 20 in position for driving and aiming but then releases to minimize peak recoil forces that can be transmitted to unmanned underwater vehicle 10.

Figure 2:
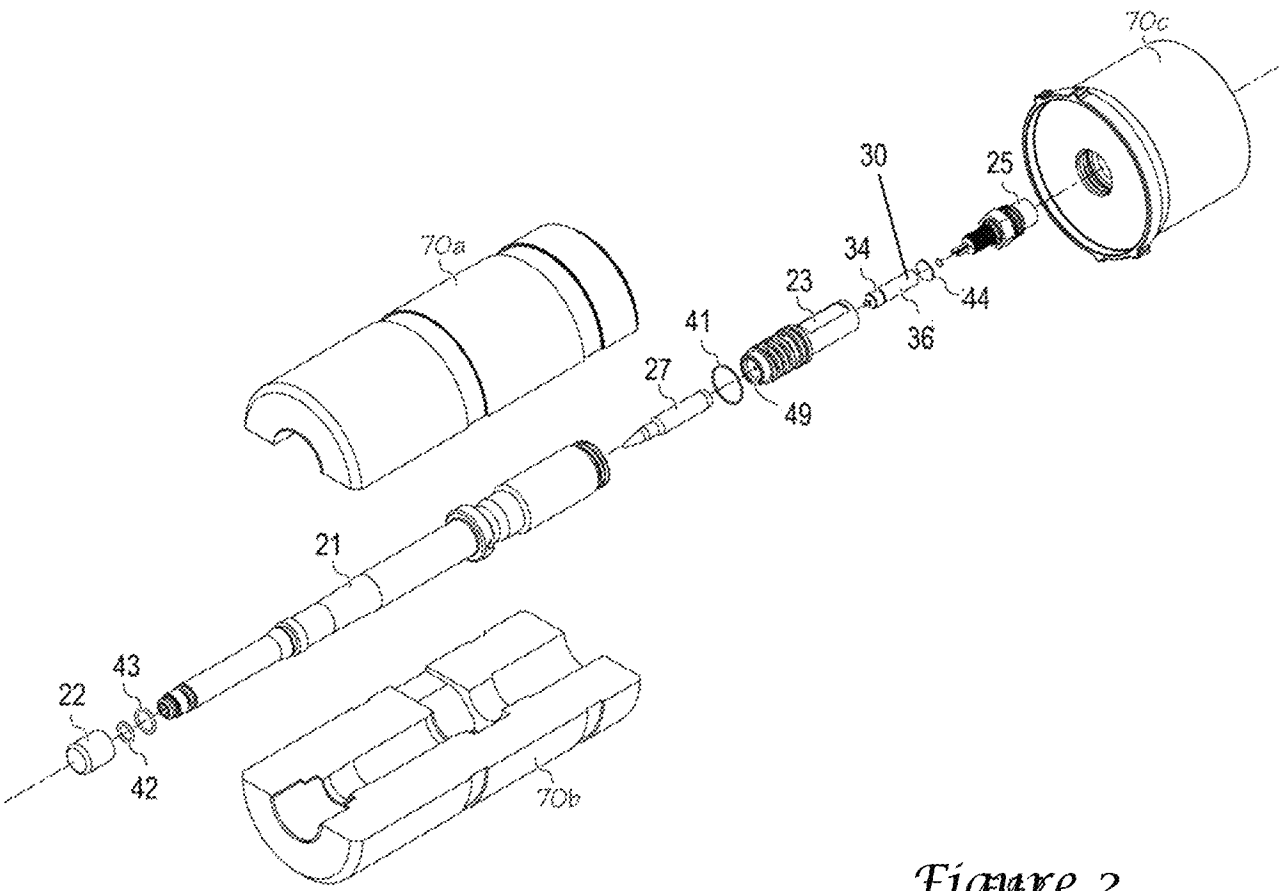
FIG. 2 is an isometric view of the underwater firearm from FIG. 1 along with a floatation cover, in accordance with one embodiment.

With reference now to FIG. 2, there is depicted an isometric view of firearm 20 along with floatation cover 70, in accordance with one embodiment. As shown, floatation cover 70 includes two half modules 70*a*-70*b* and an end cap module 70*c*. Floatation cover 70 provides independent neutrality such that the attachment of firearm 20 to an unmanned underwater vehicle will not cause unmanned underwater vehicle 10 to float or sink, and will not create unnecessary torque that can make unmanned underwater vehicle 10 unstable or difficult to maneuver, and will not require excessive use of thrusters to maintain its position. Independent neutrality also allows for firearm 20 to detach during its recoil event without affecting the stability and buoyancy of unmanned underwater vehicle 10.

Floatation cover 70 does not prohibit any functionality of firearm 20 before or during shooting. Floatation cover 70 also allows access for loading ammunition and closing a breach 49.

Firearm 20 includes a barrel 21, a barrel cap 22, a housing 23, a capsule 36, and an electrical plug 25. Barrel 21 is a hollow metal tube having a first open end and a second open end that can be referred to as the chamber and the muzzle, respectively. The inside of barrel 21 includes rifling twist consisting of lands and grooves to induce a rotation in a projectile. Alternatively, the inside of barrel 21 can be a smooth bore or cylindrical.

An ammunition cartridge 27 can be loaded into barrel 21 from the first end of barrel 21. In order to prevent water from entering barrel 21 when firearm 20 is submersed under water, the first end of barrel 21 can be covered by housing 23 along with an O-ring 41, and the second end of barrel 21 can be covered by a barrel cap 22 along with two O-rings 42, 43.

Housing 23 is a metal tube having a first end and a second end. The first end of housing 23 fits with the first end of barrel 21 via O-ring 41. The second end of housing 23 fits with electrical plug 26 via an O-ring 44. Electrical plug 26 may be contained and sealed inside capsule 36. Electrical plug 26 is designed for underwater use, and it includes a combination of bonded conductor and insulator materials.

Capsule 36 can be inserted within housing 23. A firing pin 34 is connected to a first end of capsule 36. The second end of capsule 36 is configured to receive electrical plug 26. Capsule 36 contains an electrical ignitor 30.

Figure 3:
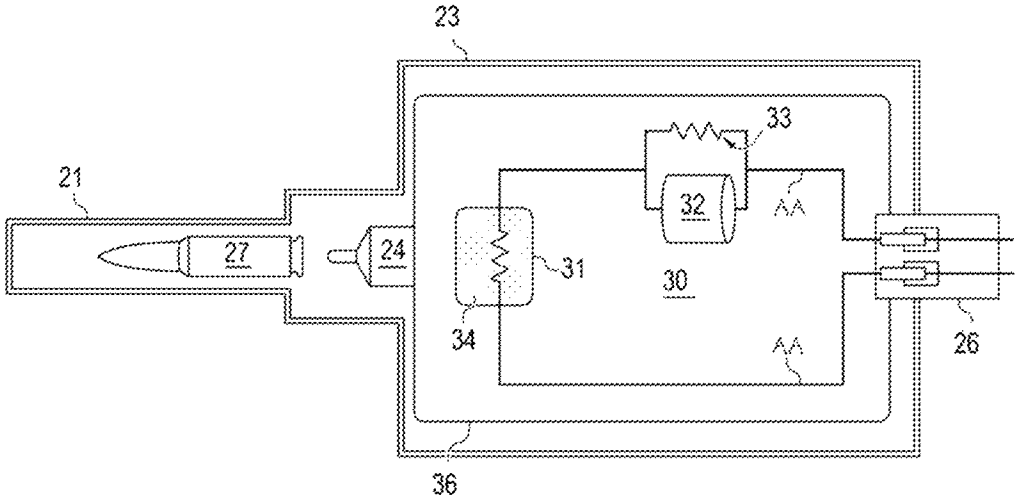
FIG. 3 is a circuit diagram of an electrical ignitor within the firearm from FIG. 1, according to one embodiment.

Referring now to FIG. 3, there is illustrated a circuit diagram of electrical ignitor 30, according to one embodiment. As shown, electrical ignitor 30 includes a bridge resistor 31 and a threshold activated interrupt 32. Bridge resistor 31 is embedded within or adjacent to a reactive material 34 such that reactive material 34 can be ignited by bridge resistor 31 when bridge resister 31 has reached a predetermined temperature. Threshold activated interrupt 32 functions as a safety switch for electrical ignitor 30. Threshold activated interrupt 32 is connected in parallel with a bridge resistor 33. Threshold activation interrupt 32 can be a pressure value to be activated based on the water depth of firearm 20, a timer to be activated based on time since deployment of unmanned underwater vehicle 10, a module for receiving commands remotely, a voltage threshold module, or an insertion/removal of a safety key. The safety key concept would be human interaction with unmanned underwater vehicle 10 to arm firearm 20.

For electrical ignitor 30, at least 0.5 μA current is needed to provide ignition. The current can be provided from an unmanned underwater vehicle, such as unmanned underwater vehicle 10 from FIG. 1, via electrical plug 26. The current can also be provided by electrical wires connected to an electric power supply or by a remote acoustic, radio frequency, optic communication device closing a switch to a battery pack controlled by a human operator. It is understood by those skilled in the art that electric current can also be provided by many other types of circuits and power supplies.

The electrical current in wires AA within electrical ignitor 30 must be high enough in order to ignite reactive material 34 contained within capsule 36. After bridge resister 31 has reached a predetermined temperature, reactive material 34 will be ignited. The gas expansion generated by the explosion of reactive material 34 then pushes firing pin 24 through a small opening 49 located in the first end of housing 23, which in turn, strikes a percussion primer (not shown) at one end of ammunition cartridge 27. As a result, the projectile (or bullet) of ammunition cartridge 27 will separate from the casing (or shell) of ammunition cartridge 27 and travels along the bore of barrel 21 to exit through the second end of barrel 21, while the casing of ammunition cartridge 27 remains at the first end of barrel 21. The force of the projectile exiting the second end of barrel 21 is more than sufficient to break the thin material of plastic or metal barrel cap 22.

Figure 4A:
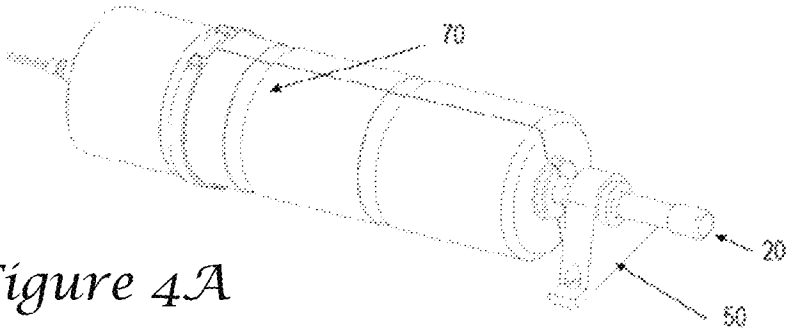
FIGS. 4A-4B are isometric views of the underwater firearm from FIG. 1 along with a slip mechanism, in accordance with one embodiment.
Figure 4B:
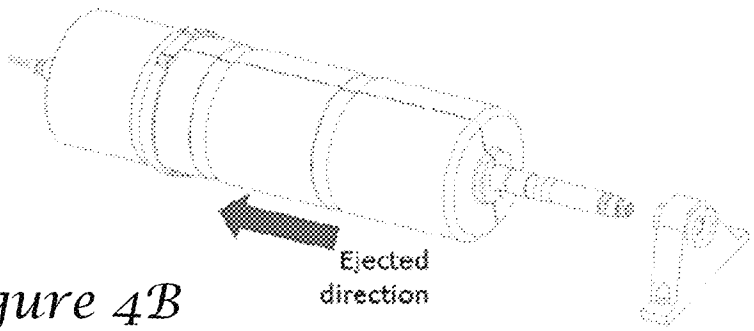

With reference now to FIGS. 4A-4B, there are illustrated an isometric view of underwater firearm 20 along with slip mechanism 50, in accordance with one embodiment. Underwater firearm 20 is purposely designed to release or break at a low force from a rigid joint via slip mechanism 50. Slip mechanism keeps firearm 20 in position for driving and aiming, as shown in FIG. 4A, and the slip mechanism releases at a minimize peak recoil force transmitted to underwater vehicle 10, as depicted in FIG. 4B.

Figure 5A:
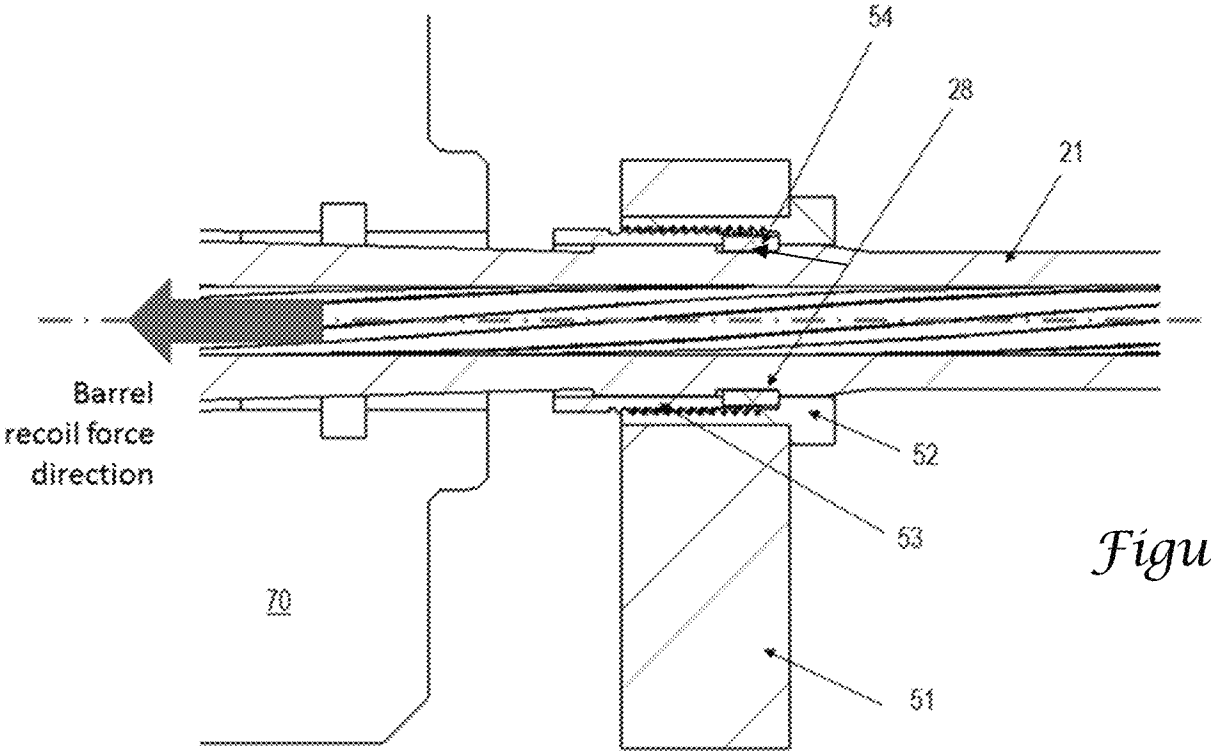
FIGS. 5A-5B are cross-sectional views showing the details of the slip mechanism from FIGS. 4A-4B, in accordance with one embodiment.
Figure 5B:
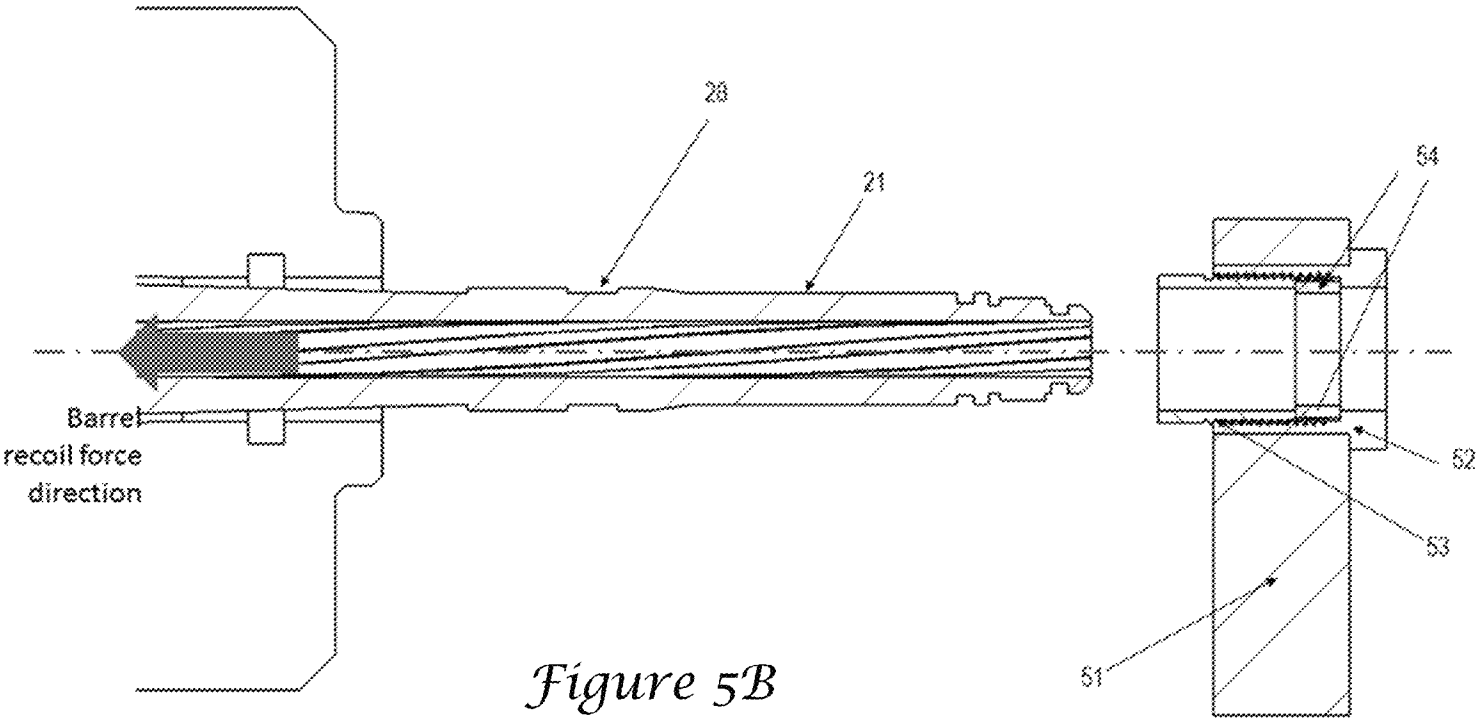

Referring now to FIGS. 5A-5B, there are depicted cross-sectional views showing the details of slip mechanism 50, in accordance with one embodiment. As shown, slip mechanism 50 includes a pillow block 51, a collet 52, a capture nut 53, and a shear ring 54. Pillow block 51 allows slip mechanism 50 to be tightly secured to unmanned underwater vehicle 10. For example, pillow block 51 can be bolted to unmanned underwater vehicle 10.

Shear ring 54 sits within a barrel groove 28 of barrel 21. Barrel groove 28 is a circular recess around barrel 21. Shear ring 54 can be made of polymer or low-yield metal.

In a mounted position prior to firing, both collet 52 and capture nut 53 confine shear ring 54 within barrel groove 28 in order to secure barrel 21 of underwater firearm 20 to enable accurate aiming, as shown in FIG. 5A. Additionally, collet 52 is attached firmly to pillow block 51 that is attached firmly to unmanned underwater vehicle 10.

In an ejected position after firing, shear ring 54 allows barrel 21 of underwater firearm 20 to slip out in response to the recoil force, as shown in FIG. 5B.

As has been described, the present invention provides an underwater firearm for unmanned underwater vehicles.

While the invention has been particularly shown and described with reference to a preferred embodiment, it will be understood by those skilled in the art that various changes in form and detail may be made therein without departing from the spirit and scope of the invention.

What is claimed is:

1. A slip mechanism for removably securing an underwater firearm to an unmanned underwater vehicle, said slip mechanism comprising:

a pillow block secured to said unmanned underwater vehicle;

a shear ring situated within a barrel groove of a barrel of said underwater firearm;

a collet wraps around said shear ring; and a capture nut, along with said collet, confines said shear ring within said barrel groove in order to secure said barrel to enable accurate aiming before firing.

2. The slip mechanism of claim 1, wherein said shear ring is made of polymer.

3. The slip mechanism of claim 1, wherein said shear ring is made of metal.

4. The slip mechanism of claim 1, wherein said pillow block is bolted to said unmanned underwater vehicle.

5. The slip mechanism of claim 1, wherein said barrel of said underwater firearm receives an ammunition on a first end.

6. The slip mechanism of claim 5, wherein said underwater firearm includes a housing for covering said first end of said barrel.

7. The slip mechanism of claim 6, wherein said underwater firearm includes a housing and a capsule, contained within said housing, for enclosing a firing pin;

a reactive material; and an electrical ignitor for igniting said reactive material to propel said firing pin to strike said ammunition in said barrel.

8. An unmanned underwater vehicle comprising:

a submersible body having a plurality of horizontal and vertical propulsion systems;

a control unit connected to said unmanned und rater vehicle via a flexible cable; and an underwater firearm mounted on said unmanned underwater vehicle, wherein said underwater firearm includes:

a barrel for receiving an ammunition on a first end;

a slip mechanism for removably securing said underwater firearm to said unmanned underwater vehicle, said slip mechanism includes a pillow block secured to said unmanned underwater vehicle;

a shear ring situated within a barrel groove of said barrel;

a collet wraps around said shear ring, and a capture nut, along with said collet, confines said shea ring with said barrel groove in order to secure said barrel to enable accurate aiming before firing.

9. The unmanned underwater vehicle of claim 8, wherein said shear ring is made of polymer.

10. The unmanned underwater vehicle of claim 8, wherein said shear ring is made of metal.

11. The unmanned underwater vehicle of claim 8, wherein said pillow block is bolted to said unmanned underwater vehicle.

12. The unmanned under ater vehicle of claim 8, wherein said underwater firearm includes a housing for covering said first end of said barrel.

13. The unmanned underwater vehicle of claim 12, wherein said underwater firearm includes a housing and a capsule contained within said housing, for enclosing a firing pin;

a reactive material; and an electrical ignitor for igniting said reactive material to propel said firing pin to strike said ammunition in said barrel.

14. The unmanned underwater vehicle of claim 13, wherein said electrical ignitor includes a bridge resistor embedded within said reactive material.

15. The unmanned underwater vehicle of claim 13, wherein said capsule includes a pressure valve for allowing said underwater firearm to be activated at a predetermined water depth.

16. The unmanned underwater vehicle of claim 15, wherein said pressure valve is connected in parallel with a bridge resistor.

17. The unmanned underwater vehicle of claim 15, wherein said capsule includes a timer for allowing said underwater firearm to be activated after a predetermined amount of time has lapsed since deployment.

18. The unmanned underwater vehicle of claim 17, wherein said timer is connected in parallel with a bridge resistor.

* * * * *